US006032747A

United States Patent [19]

Moody et al.

[11] Patent Number: 6,032,747

[45] Date of Patent: Mar. 7, 2000

[54] WATER-BASED DRILLING FLUID DEACIDIFICATION PROCESS AND APPARATUS

[75] Inventors: Eugene I. Moody; Donald A. Thorssen, both of Calgary, Canada

[73] Assignee: Underbalanced Drilling Systems Limited, Canada

[21] Appl. No.: 09/095,118

[22] Filed: Jun. 10, 1998

[51] Int. Cl.[7] ..... C09K 7/00

[52] U.S. Cl. ..... 175/71; 175/205

[58] Field of Search ..... 175/65, 71, 72, 175/205, 206

[56] References Cited

U.S. PATENT DOCUMENTS

| | | | |
|---|---|---|---|
| 4,350,505 | 9/1982 | Mallory et al. | 55/227 |
| 5,093,008 | 3/1992 | Clifford, III | 210/725 |
| 5,412,940 | 5/1995 | Baugh | 60/274 |
| 5,663,121 | 9/1997 | Moody | 507/102 |
| 5,749,422 | 5/1998 | Michael | 175/71 |
| 5,775,442 | 7/1998 | Speed | 175/48 |
| 5,890,549 | 4/1999 | Sprehe | 175/71 |
| 5,928,519 | 7/1999 | Homan | 210/741 |

*Primary Examiner*—Frank Tsay
*Attorney, Agent, or Firm*—Young & Basile, P.C.

[57] ABSTRACT

A method and an apparatus is provided for use in an underbalanced drilling process using exhaust gases wherein some constituents of the exhaust gas combine with water to form acids. The present invention provides a means of deacidifying drilling fluids. The pH of the drilling fluid is monitored and adjusted to prevent corrosion of equipment by acidic drilling fluids. The drilling fluid may also be optionally treated with anti-scaling agents. The drilling fluid may be a gas, a liquid or a combination of both or it may be gasified oil based drilling fluid.

21 Claims, 1 Drawing Sheet

WATER-BASED DRILLING FLUID DEACIDIFICATION PROCESS AND APPARATUS

SCOPE OF THE INVENTION

The present invention relates to improvements in underbalanced drilling of a well bore where on-site engine exhaust gases are used to provide the gas stream for gasifying drilling mud. More particularly, it relates to the deacidification of drilling fluids to prevent or impede the corrosion of equipment.

BACKGROUND OF THE INVENTION

Traditionally oil and gas wells have been drilled using a drill bit connected to the lower end of a drill string. As the drill bit penetrates the earth, the drill string is gradually lengthened. A drilling fluid is usually pumped downward through the drill string to the drill bit to flush and wash away cuttings and debris from around the drill bit and to cool and lubricate the drill bit. The cuttings, debris and mud are returned under pump pressure upwardly through the annulus between the drill string and the walls of the well bore. This process requires large volumes of water and results in the generation of large quantities of contaminated drilling mud that must be stored and then transported and disposed. This has obvious disadvantages both economic and environmental.

U.S. Pat. No. 5,093,008 discloses a dewatering process for recovering water from waste drilling fluid. The process includes chemically inducing flocculation in the waste drilling fluid. The drilling fluid is subsequently transferred to a centrifuge where it is separated into solid waste and clear reusable water.

Another problem associated with drilling of well bores is that oxygen from the atmosphere may contaminate the drilling fluid. Oxygen in the drilling fluid is a major disadvantage because the circulation of the fluids in the well bore brings the drilling fluid into contact with the entire interior and exterior surfaces of the drill string and drill bit. Since oxygen in drilling fluids causes corrosion of any metal surface it contacts, this could result in serious damage to very expensive equipment. In addition, in some drilling environments, oxygen could provide an explosive mixture. U.S. Pat. No. 4,350,505 discloses means whereby the oxygen content of the drilling fluid is replaced by nitrogen or exhaust gases. This however only relates to replacing oxygen in fluids and does not reduce the quantity of water required.

An improved method of well bore drilling is termed underbalanced drilling. The term underbalanced drilling refers to drilling operations where the hydrostatic head of the fluid column is lower than the reservoir pressure. The use of air or other gas as the circulating drilling fluid is well known in the industry. Gas drilling results in increased drill bit life and reduced drilling time. However, when oxygen containing gases such as atmospheric air are used, there is a danger of down-hole explosions. Another drawback of drilling using atmospheric air or aerated drilling fluids is the resultant high oxygen level downhole since, as stated above, this is associated with accelerated corrosion of drill parts. Applicant's U.S. Pat. No. 5,663,121 addresses some of these disadvantages. It discloses a method of using exhaust gases from engines at the drill site as the source of gas for underbalanced drilling which provides for a safer and more economic process. It is clearly apparent, however, that the exhaust from various types of engines can be used, for example, from the engines which drive the drill rig, and most preferably from the engines which drive the exhaust gas compressor. The present invention discloses further improvements of the process. It has now been found that the presence in exhaust gases of constituents such as carbon dioxide, oxides of nitrogen and oxides of sulphur can contribute to acidification of the drilling fluid which may enhance corrosion of metal equipment and may also contribute to the deposit of a scale-like substance on down-hole equipment. While the process disclosed in U.S. Pat. No. 5,663,121 can effectively neutralize the ability of the exhaust gases to create acids within the compression system where only small residual amounts of water are involved, there remains a real and unsatisfied need to develop improved methods of preventing or reversing the acidification process that are cost-effective. The present invention is directed to the development of such a method.

SUMMARY OF THE INVENTION

According to one aspect of the present invention a process for the deacidification of drilling fluids from an underbalanced drilling process using compressed engine exhaust gases from engines at the drill site, comprises the steps of:

i) compressing engine exhaust gases to greater than drilling fluid pressure and introducing said compressed exhaust gases into said drilling fluid to form an underbalanced drilling fluid;

ii) passing the pressurized drilling fluid down hole via a drill string through a drill bit and returning spent drilling fluid via well bore annulus;

iii) directing spent drilling fluid to a solids-liquid-gas separator to separate said spent drilling fluid; the improvement comprising:

iv) monitoring pH of said fluid; and v) introducing to said fluid, as needed in accordance with said monitored pH, a base reagent and reducing thereby corrosive properties of said drill fluid when said fluid is downhole.

In another aspect of the invention, there is an additional step of adding an anti-scaling agent to the drilling fluid.

BRIEF DESCRIPTION OF THE DRAWINGS

Various aspects of the invention are described with respect to the drawing wherein.

DETAILED DESCRIPTION OF THE PREFERRED EMBODIMENTS

Figure 1:
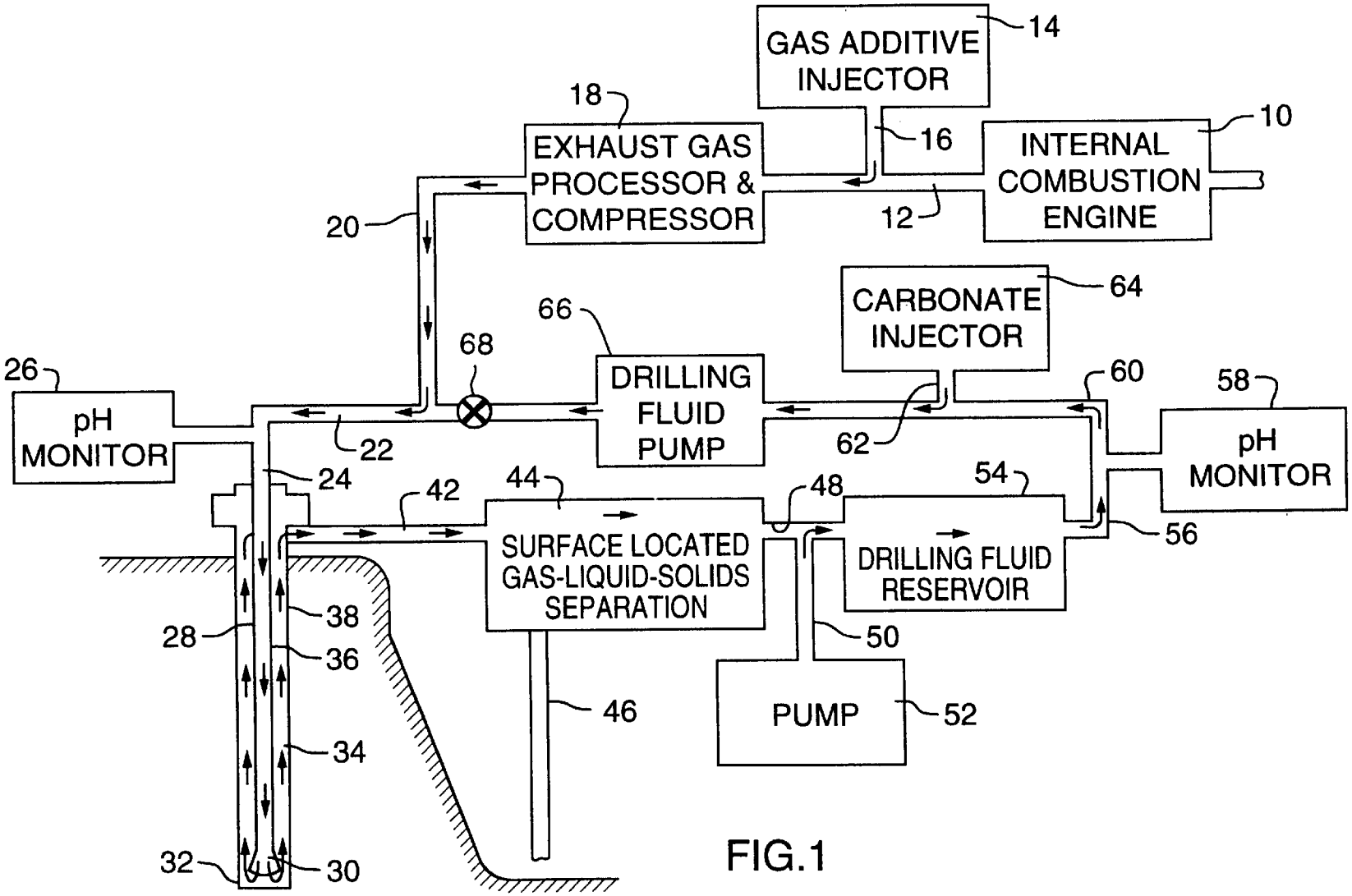
FIG. 1 is a schematic outline of the process and apparatus.

Gas drilling, or underbalanced drilling has many advantages. The penetration rate is increased due to the reduced differential pressure between the drilling fluids and the surrounding earth and this also contributes to extended drill bit life. The technology of the aforementioned U.S. Pat. No. 5,663,121 provides for a safer and more cost efficient method of gas drilling. However, without an economic de-acidification process, the concept of using processed exhaust gas for underbalanced drilling may present a corrosion problem in most underbalanced drilling environments.

The present invention addresses this problem through the development of an improved underbalanced drilling process and apparatus where the pH of the drilling fluid is monitored and controlled to avoid downhole corrosion.

Referring to a preferred embodiment of the apparatus, as illustrated in FIG. 1, the process commences with the introduction of exhaust gases from an internal combustion engine 10 into a conduit 12 where they are optionally mixed with a gas phase precursor of a base compound, such as ammonia ($NH_3$) which may be introduced into conduit 12 from injector 14 through conduit 16. While, in a preferred embodiment, the exhaust gas is derived from the engines driving the compressors, it is clearly apparent that the exhaust gases may be derived from various types of engines which operate equipment at the drill site. The exhaust gases are delivered to an inlet side of an exhaust gas processor and compressor 18. Depending on the type of underbalanced drilling being employed, the gases may be pressurized to various levels. After processing and compression, the exhaust gases leave the compressor 18 and are directed into conduit 20. Of course, it is clearly apparent to one skilled in the art that the optional gas phase precursor could be added subsequent to the processing and compression stage. The purpose of the gas phase precursor is such that when the gases contact the liquid phase, the additive forms a base reagent to neutralize acid in the liquid phase. For example, when ammonia reacts with water it forms ammonium hydroxide. Although the discussion of the preferred embodiments of the invention are directed to a water-based drilling mud, it is understood that the technology may also be applied to a gaseous based and oil based underbalanced drilling fluids. In respect of a water-based drilling mud, it is generally understood that about 30 to 40 cubic meters of gas is introduced to approximately one half of a cubic meter of liquid to form the gasified drilling fluid. In this state the fluid is usually in the form of a foam or mist depending upon the rate of gas introduction to the water. With a gaseous drilling fluid no water is present other than what is picked up downhole during the drilling process. With oil based systems the oil is gasified in a manner similar to that with water where a mist or a foam of the oil and gas is formed for purposes of underbalanced drilling. It is generally understood however, that the waterbased drilling systems are the most used because of the abundance of water and the ability to readily clean the spent waters.

The gases then continue through conduit 20 into conduit 22 where they are blended with water based drilling liquid to form a less dense, gasified liquid. Conduit 22 intersects with conduit 24 where the pH of the liquid is monitored by pH monitor 26. If the pH of the gasified liquid is outside the desired range then the rate of injection of the optional gaseous base precursor is increased or decreased appropriately. The pH of the liquid entering the drill string is typically appreciably above neutral. This is necessary in order to compensate for the increased pressure down hole that leads to increased solubility of certain components of the exhaust gases, such as $CO_2$, and the resultant decrease in pH which then becomes increasingly corrosive down hole. When the spent drilling liquid is returned to the surface, the pH will typically increase again. The rate of injection of the gas phase additive may be adjusted manually or electronically by an operator receiving the results of the pH monitoring or the rate of injection may be adjusted automatically in conjunction with the pH meter results.

From conduit 24, the drilling liquid is directed into the drill string 28. After entering the drill string 28, the gasified liquid proceeds down to the drill bit 30 where it exits into the well bore 32. The gasified liquid together with the cuttings and debris from the drilling process is then directed back to the surface through the annulus 34 formed between the outer perimeter 36 of the drill string and the inner perimeter 38 of the well bore 32. During the drilling, the liquid may become acidified by the water reacting with, for example, the carbon and/or nitrogen and/or sulfur oxides of the exhaust gas to form carbonic and/or nitric and/or sulfuric acids in the following ways:

Carbon dioxide $$9CO_2+nH_2O \rightarrow 8CO_{2(aq)}+H_2CO_3$$

Sulphur Trioxide $$SO_3+H_2O \rightarrow H_2SO_4$$

Nitrogen Oxide and Nitrogen Dioxide $$NO_2 \rightarrow N_2O_4$$

$$N_2O_{4+}H_2O \rightarrow HNO_2+HNO_3$$

$$3HNO_2 \rightarrow H_2O+2NO+HNO_3$$

$$2NO+O_2 \rightarrow 2NO_2$$

From the annulus, the gasified and acidified drilling liquid travels through conduit 42 to a gas-liquid-solid separator 44 where the produced hydrocarbon gas and the exhaust gas are vented to the atmosphere through a flare stack 46. In one aspect of the invention, the liquid and solid phases are separated through gravitational sedimentation. The separation of the liquid and solid phases may be accomplished by different means. For example, there may be a series of separator tanks, one where sedimentation is ongoing, while in another, the sedimentation is complete and the solids are being evacuated, and in another the separation is complete. The solid fraction may be evacuated through a variety of means. For example, it may be manually carted out after removal of the liquid phase, or an auger or chain tracks may be employed. It is clearly apparent to one skilled in the art that the solid waste may be treated in a variety of ways.

Once separated, the liquid phase is ready for recycling. The liquid exits the separator 44 into a conduit 48. The liquid proceeds along conduit 48 which intersects with a conduit 50 through which in accordance with a preferred aspect of the invention, a base reagent is injected by a pump 52. In a preferred embodiment of the invention, the base reagent is a hydroxide such as $Ca(OH)_2$, NaOH, $NH_4OH$, KOH or $Mg(OH)_2$. The pump 52 forces the hydroxide source into the conduit 48 where the fluid is deacidified as it blends with the hydroxide source. This type of acid treatment is believed to be easier to accomplish than the gas precursor approach, however both techniques may be used singularly or in combination.

Treatment of the water-based drilling fluid with a hydroxide ion source neutralizes the acidification process in the following reactions:

$$OH+H_2CO_3 \leftrightarrows H_2O+HCO_3^-$$

$$OH+HCO_3 \leftrightarrows H_2O+CO_3^-$$

$$OH+H_2SO_4 \leftrightarrows H_2O+HSO_4^-$$

$$OH+HSO_4 \leftrightarrows H_2O+SO_4^-$$

$$OH+HNO_3 \leftrightarrows H_2O+NO_3^-$$

The source of the hydroxide ion (OH) above is of the form: X(OH)n where n is a positive integer equal to or greater than 1 (i.e. n=1, 2, 3, 4 . . . ) and X represents an element or group of elements with an oxidation state equal to the value of n.

Some examples are:

$Ca(OH)_2$—Calcium Hydroxide (Lime)

Na(OH)—Sodium Hydroxide (Caustic)

$NH_4(OH)$—Ammonium Hydroxide

After the treatment, the liquid is directed through conduit 48 to the drilling fluid reservoir 54. Subsequently, the liquid travels along the conduit 56 where the pH is measured by a pH probe 58. If the pH detected by the probe 58 is not within a set desired range, the rate of injection of the base reagent is adjusted accordingly. While it is clear to one skilled in the art that numerous means may be employed to redirect drilling liquid which does not register within the desired pH range which is preferably above about 10, it is not essential to maintain a very tight pH control at all times. Quite surprisingly, applicant has found that by elevating pH of the drilling fluid, above at least 8 and preferably above 10 before re-entry to the bore hole, a build up of a corrosion resistant layer develops on the steel pipe interior surfaces. Such corrosion resistant layer is believed to be the result of hydroxyl ions in the fluid encouraging the formation of carbonate and bicarbonate ions. It is thought that these carbonate and bicarbonate ions react with iron on the surface of the steel pipe to form iron complexes. The nature of these complexes is not fully understood, however, they are though to be of iron carbonate and/or for iron oxide (maghemite, lepidocrocite and possibly magnetite). These complexes bind to the surface to develop the corrosion resistant layer which functions as a self inhibiting barrier. This barrier resists any corrosive effects of the drilling fluid should the pH of the fluid drop due to a lack of supervision. This unexpected feature provides a failsafe mechanism which eliminates the need for continuous monitoring and administration of base component.

From conduit 56 the liquid is subsequently directed into conduit 60 where it intersects with conduit 62 which optionally delivers an anti-scaling agent from the injector 64. The anti-scaling agent is preferably of the general structure $Z_mH_nY$ where Z is an alkali metal or ammonium ($NH_4$), H represents a hydrogen atom and Y is selected from the group consisting of $CO_3$, $SO_3$, $SO_4$, $PO_3$, $PO_4$, $SiO_3$ or $SiO_4$. Some examples of anti-scaling agents include, but are not limited to, sulphates, silicates, phosphates, carbonates, bicarbonates, bisulphates, bisulphites, and sulphites.

In a preferred embodiment of the invention, treatment with a carbonate ion source (or similar oxo-acid) causes the following reactions to take place in the surface system thereby preventing scaling downhole as some of the precipitants of the reaction try to attach themselves to exposed metal surfaces.

In the above formula,

Where Y is a Divalent Anion $$Z_mH_nY+P^{2+}\rightarrow mZ^{q+}+nH^{+}+PY \text{ (solid precipitate)}$$

where:

$Z^{q+}$ is a cation with an oxidation state of $q^+$

Y is an oxo-acid anion

P is an element or ionic group such that its oxidation state equals +2 Examples:

$$Na_2CO_3+Ca^{2+}\rightarrow 2Na^{+}+CaCO_3$$

$$K_2SO_4+Ca^{2+}\rightarrow 2K^{+}+CaSO_4$$

$$Na_2CO_3+Mg^{2+}\rightarrow 2Na^{+}+MgCO_3$$

Where Y is a Trivalent Anion $$Z_mH_nY+P^{2+}\rightarrow mZ^{q+}+PH_nY$$

example:

$$Na_2HPO_4+Ca^{2+}\rightarrow 2Na^{+}+CaHPO_4$$

or $$2Z_mH_nY+P^{2+}\rightarrow mZ^{q+}+P(H_nY)_2$$

example:

$$2NaH_2PO_4+Ca^{2+}\rightarrow 2Na^{+}+Ca(H_2PO_4)_2$$

or $$2Z_mH_nY+3P^{2+}\rightarrow 2mZ^{q+}+2H_n^{+}+P_3Y_2$$

example:

$$2Na_3PO_4+3Ca^{2+}\rightarrow 6Na^{+}+Ca_3(PO_4)_2$$

Where Y is a Univalent Anion $$2Z_mH_nY+P^{2+}\rightarrow 2mZ^{q+}+2H_n^{+}+PY_2$$

Having been deacidified by the hydroxide source and optionally treated with a carbonate source, or other oxo acid, the water based drilling liquid continues through conduit 60 where it enters the drilling liquid pump 66 and begins the circuit again.

In another embodiment, the drilling fluid is gaseous. Referring again to FIG. 1, in a totally gaseous system, exhaust gases from an internal combustion engine 10 travel through conduit 12 where they may be blended with a gas phase additive introduced through conduit 16 from injector 14. The exhaust gases are then delivered to a processor/compressor 18. Subsequently, the compressed gas is directed into conduit 20. The gas phase additive could alternatively be introduced after the processing and compression stage. The gases then continue through conduit 22 to conduit 24. When the system is operating with gaseous drilling fluids, an optional one-way valve 68 prevents gas from backflowing to the drilling fluid pump. From conduit 24, the gaseous drilling fluid is directed into the drill string 28. After entering the drill string 28, the gaseous drilling fluid proceeds down to the drill bit 30 where it exits into the well bore 32. The gaseous drilling fluid is then directed back to the surface through the annulus 34. When a gaseous drilling fluid is used, the only water present is that accumulated down-hole. From the annulus, the gaseous drilling fluid travels through conduit 42 to a gas-liquid-solid separator 44 where the used gases are vented to the atmosphere through a flare stack 46.

While preferred embodiments have been described with regard to the drawing, it is understood that the present description has been made only by way of example. It is clearly apparent to one skilled in the art that the pH of the drilling fluid may be measured before, after or before and after injection of the hydroxide source. It is also clearly apparent that neutralization of the drilling liquid may be accomplished through addition of the gas phase additive alone, the liquid base reagent alone or through the combination of the two. Similarly, numerous changes in the details of construction and the combination and arrangement of parts as would be apparent to one skilled in the art may be resorted to without departing from the spirit and scope of the invention.

We claim:

1. In an underbalanced drilling process using compressed engine exhaust gases from engines at the drill site to provide a drilling fluid for underbalanced drilling purposes, the process including the steps of:

i) compressing engine exhaust gases to greater than drilling fluid pressure and introducing said compressed exhaust gases into said drilling fluid to form an under-balanced drilling fluid;

ii) passing the pressurized drilling fluid down hole via a drill string through a drill bit and returning spent drilling fluid via well bore annulus;

iii) directing spent drilling fluid to a solids-liquid-gas separator to separate said spent drilling fluid; the improvement comprising:

iv) monitoring pH of said fluid; and v) introducing to said fluid as needed in accordance with said monitored pH, a base reagent and reducing thereby corrosive properties of said drill fluid when said fluid is downhole.

2. In a process of claim 1, said drilling fluid is a liquid which is gasified by said exhaust gases to reduce its density and is separated as a liquid from solids-liquids-gas separator.

3. In a process of claim 2, said step of adding said base reagent is either upstream or downstream of said pH monitoring step.

4. In a process of claim 2 said base reagent being added to said exhaust gases.

5. In a process of claim 4, said base reagent being a gaseous precursor to said base reagent when said gaseous precursor is admixed with water.

6. In a process of claim 5, said gaseous precursor being ammonia ($NH_3$).

7. In a process of claim 2 said base regent being added to said liquid.

8. In a process of claim 7, said base reagent being a hydroxide.

9. In a process of claim 8, said hydroxide being selected from the group of hydroxides represented by the formula $X(OH)_n$, wherein X represents an element or group of elements with an oxidation state equal to n which is a positive integer equal to or greater than 1.

10. In a process of claim 9, said X represents an alkali or alkaline earth metal.

11. In a process of claim 9, said hydroxide being selected from the group consisting of $Ca(OH)_2$, NaOH, $NH_4OH$, KOH, $Mg(OH)_2$ and mixtures thereof.

12. In a process of claim 2, the additional step of adding an anti-scaling agent to said liquid to reduce scale build up.

13. In a process of claim 12, said antiscaling agent is represented by a compound of the formula $Z_mH_nY$ wherein Z is an alkali metal or ammonium, H is hydrogen and Y is $CO_3$, $SO_4$, $SO_3$, $PO_3$, $PO_4$, $SiO_3$ or $SiO_4$, and m and n are integers equal to or greater than zero.

14. In a process of claim 12, said anti-scaling agent is selected from the group consisting of a carbonate, a sulphate, a phosphate, a silicate and mixtures thereof.

15. In a process of claim 14, said carbonate being $Na_2CO_3$ or $K_2CO_3$.

16. In a process of claim 14, said sulphate being $K_2SO_4$ or $Na_2SO_4$.

17. In a process of claim 14, said anti-scaling agent being $(NH_4)$ $H_2$ $PO_4$, $K_3$ $PO_4$ or $Na_3$ $PO_4$.

18. In a process of claim 14, said antiscaling agent being $Na_2$ $SiO_3$.

19. In a process of claim 1, wherein said drilling fluid is gaseous and wherein said step of adding said base reagent is either upstream or downstream of said compressing step.

20. In a process of claim 19, said base reagent being added to exhaust gases.

21. In a process of claim 20, ssaid base reagent being ammonia ($NH_3$).

* * * * *